US006042304A

United States Patent [19]

Manning

[11] Patent Number: 6,042,304

[45] Date of Patent: Mar. 28, 2000

[54] PILE DRIVING SYSTEM AND METHOD

[75] Inventor: Gerald R. Manning, Oakley, Calif.

[73] Assignee: Foundation Constructors, Inc., Oakley, Calif.

[21] Appl. No.: 08/876,976

[22] Filed: Jun. 16, 1997

[51] Int. Cl.[7] ..... E02D 5/52; E02D 7/00

[52] U.S. Cl. ..... 405/255; 405/232; 405/233; 405/243

[58] Field of Search ..... 405/240, 241, 405/242, 243, 257, 255

[56] References Cited

U.S. PATENT DOCUMENTS

| | | | |
|---|---|---|---|
| 806,838 | 12/1905 | Raymond | 405/243 |
| 850,389 | 4/1907 | McClintock | 405/243 |
| 869,336 | 10/1907 | Stewart | 405/255 X |
| 1,935,903 | 11/1933 | Edman | 405/243 |
| 2,554,896 | 5/1951 | Caudill | 405/243 |
| 2,636,355 | 4/1953 | Thornley | 405/243 X |
| 3,984,992 | 10/1976 | Merjan . | |
| 4,110,989 | 9/1978 | Selkirk | 405/255 X |
| 5,228,807 | 7/1993 | Willcox | 40/255 X |

FOREIGN PATENT DOCUMENTS

| | | | |
|---|---|---|---|
| 205340 | 1/1957 | Australia | 405/243 |

OTHER PUBLICATIONS

Hardcore Fiberglass Tubular Piling™ Product Brochure (1996), Today's technology to prevent tomorrow's problem.

TPI Composites Incorporated (1997), TPI–12–5–Piling Data Sheet, TPI–14–100 Piling Data Sheet, TPI Composite Load-bearing Pilings Info Sheet, TPI Composite M–Series Dock Pilings Info Sheet.

*Primary Examiner*—Dennis L. Taylor
*Attorney, Agent, or Firm*—Flehr Hohbach Test Albritton & Herbert LLP; Richard E. Backus

[57] ABSTRACT

A pile driving system and method of operation for driving pile casings formed of a material which is a composite of fiberglass and a resin matrix. The pile casing is sleeved on a mandrel which receives driving forces from a hammer. The driving forces are directed from the mandrel into a boot plate which penetrates down as it makes a hole in the soil. The pile casing rides down with the mandrel, and as the depth increases additional sections of pile casings and mandrel segments can be added. Trapping devices are provided for trapping the pile casing relative to the mandrel so that a portion of the driving forces are directed into the pile casing.

1 Claim, 4 Drawing Sheets

PILE DRIVING SYSTEM AND METHOD

BACKGROUND OF THE INVENTION

1. Field of the Invention

This invention relates in general to systems for driving piles for on-shore and marine applications including the driving of bearing piles, fender piles and dolphins for mooring vessels.

2. Description of the Related Art

Cylindrical piles are conventionally driven into soil in both marine and on-shore applications through the use of steel mandrels which fit within the pile casings and receive repeated downwardly directed blows from hammers. The hammers can be of the diesel powered, pneumatic, hydraulic or gravity type. The hammer can have a hanging weight in the range of 16,000 to 100,000 lbs. and deliver impact forces in the range of 8,000 to 220,000 ft./lbs. Among the various types of piles in use today are cylindrical steel piles, wooden piles and pile casings which are composites of fiberglass and certain polymers. One such composite pile casing now in use is the Hardcore Fiberglass Tubular Piling®, a product of Hardcore duPont Composites, L.L.C., which comprises E-glass directional reinforcement fiberglass with a vinyl ester resin matrix, non-woven Geotectile®, polyethylene and UV inhibitors. The composite pile casings are supplied with outer diameters in the range of 8" to 18" or larger with a wall thickness varying from 0.18" to 0.46". The pile casings may also be tapered.

The tubular composite pilings are conventionally driven by means of the same equipment and methods used to drive steel and wooden piles, which essentially is by repeatedly beating the piles down by brute force. However, tubular pilings made of the above-described composite materials can be successfully driven to only a limited depth in the soil by using conventional equipment and methods. It would be desirable to provide a system and method of operation which would drive tubular composite piles deeper and thereby allow the piles to carry a greater design load. With the composite piles driven deeper, they can match the design loads achieved by steel piles. Because composite piles have only about 22% of the weight of steel piles with comparable load-bearing capacity, this would mean that the composite piles could be made cost competitive with steel piles by reducing the wall thickness and therefore reducing the amount and cost of the composite material.

U.S. Pat. No. 3,984,992 discloses a pile driving mandrel made of two arcuate segments which can be expanded into contact with the inside of a pile shell. However, the patent describes that the mandrel is for gripping a steel shell which is helically corrugated.

The need has therefore been recognized for a pile driving system and method which obviates the foregoing and other limitations and disadvantages of prior art pile drivers. In particular, there has not been provided an effective system and method for driving piles of composite materials in a manner which is competitive with steel piles. Despite the various pile driving systems and methods in the prior art, there has heretofore not been provided a suitable and attractive solution to these problems.

OBJECTS AND SUMMARY OF THE INVENTION

It is a general object of the present invention to provide a new and improved system for driving piles of the type made of composite materials, such as a composite of fiberglass with a resin matrix.

Another object is to provide a new and improved method of driving a pile which is comprised a composite material such as fiberglass in a resin mixture.

The invention in summary provides a pile driving system and method in which a mandrel is provided with a shaft that has a cylindrical wall that fits axially within the cylindrical shell of a pile casing which is formed of a material comprised of fiberglass and a resin. As the mandrel is driven down into the soil by repeated blows from a hammer, the pile casing conjointly moves down with the mandrel. In one embodiment, a pile trapping device is provided which comprises an annulus projecting radially outwardly from the foot end of the mandrel so that the pile casing moves down behind the annulus. In another embodiment, the pile casing is trapped for movement with the mandrel by structure which comprises a collar mounted about the upper end of the mandrel shaft and an annulus carried by the foot end of the mandrel. The collar can be adjusted axially on the mandrel in one embodiment by the provision of threadably mounting the collar, and in another embodiment by selectively clamping collar segments about the mandrel. In a further embodiment, the pile casing is carried down with the mandrel by a method which includes the step of expanding longitudinal segments of the mandrel against the inner surface of the pile.

The foregoing and other objects and features of the invention will appear from the following description in which the several embodiments have been set forth in conjunction with the accompanying drawings.

DESCRIPTION OF THE PREFERRED EMBODIMENTS

Figure 1:
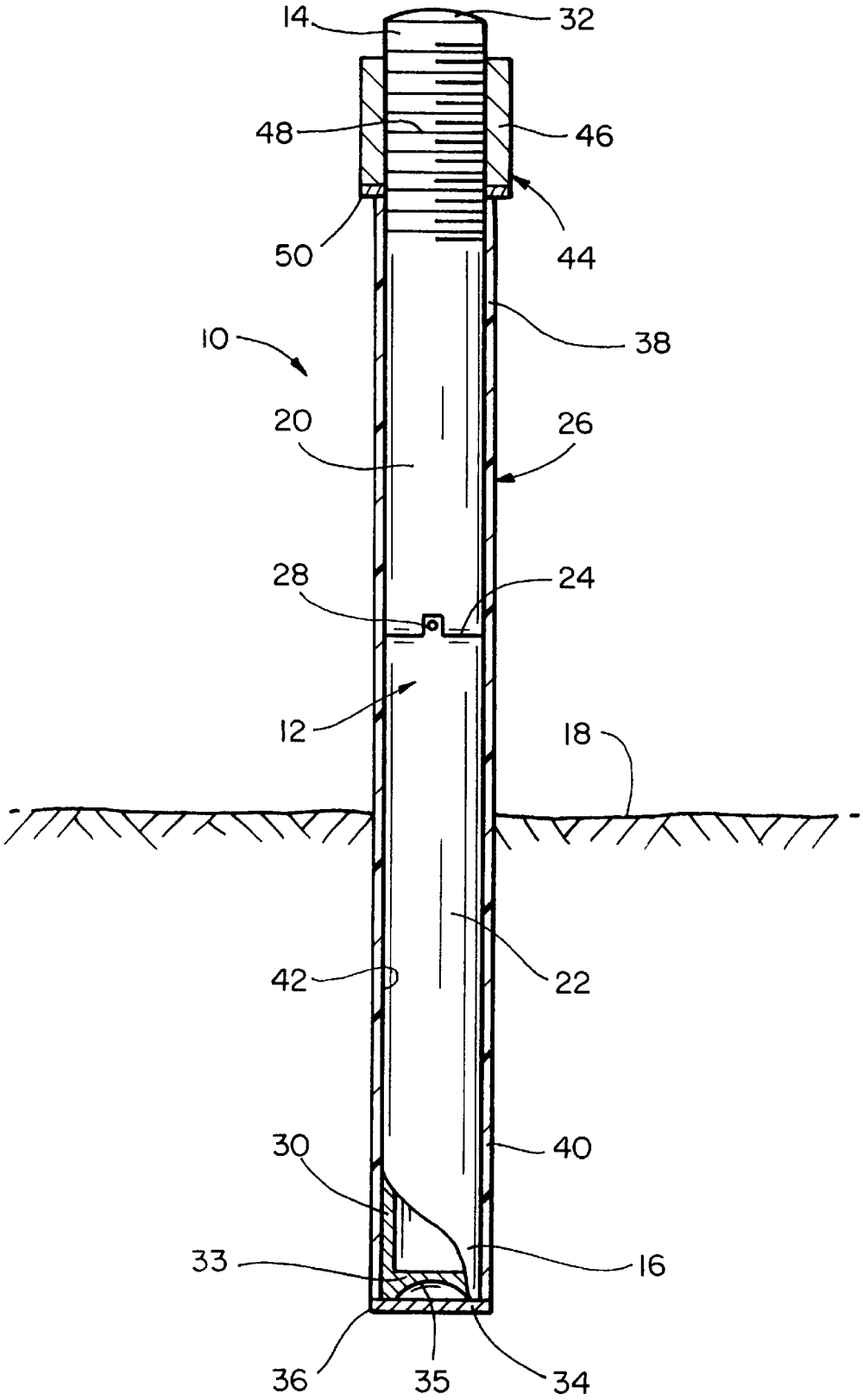
FIG. 1 is an axial section view of a pile driving system of apparatus in accordance with one embodiment of the invention.

In the drawings, FIG. 1 illustrates generally at 10 a pile driving system of apparatus in accordance with one preferred embodiment of the invention. Apparatus 10 comprises an upright mandrel 12 having a head end 14 which would be positioned below a suitable hammer, not shown, and a foot end 16 which penetrates through a hole in the soil 18, which can be on-shore ground or the bed of a body of water.

In FIG. 1, mandrel 12 is shown as comprised of two segments 20 and 22 which are connected together at a joint 24 in an end-to-end relationship along their longitudinal axes. Any number of mandrel segments could be provided, depending upon the depth to which a pile is being driven. Each mandrel segment can be advantageously made in the range of 20' to 25'. A pair of the mandrel segments, as shown, would be used to begin driving a first pile casing 26, the length of which can be in the range of 35' to 45', and typically is 40'. The joint 24 between the mandrel segments is shown as being of the tenon and socket type with a transverse bolt 28 locking the segments together. As desired, the mandrel segments could be welded together.

Each mandrel segment is formed of a cylindrical steel casing with a wall 30 having a thickness in the range of ¾' to 1.25'. At the head end 14 of the uppermost mandrel segment, a convex cap 32 (shown as domed although it could be flat as desired) is attached by welding for receiving blows from the hammer. A steel bottom or plug 33 is formed within mandrel wall 30 at the foot end of the lowermost segment. This plug is shaped with a downwardly concave recess 35 which enables distribution of the driving forces to the mandrel's outer periphery, where they are most effective. Positioned below the foot end 16 of the lowermost mandrel segment is a circular boot plate 34, which can be of ⅝" steel or fiberglass material.

The diameter of boot plate 34 is larger than the outer diameter of the steel casing so that the outer rim 36 of the plate forms an annulus. As desired, the outer diameter of the boot plate could be equal to the casing's inner diameter and recessed within it. In both of these configurations, the pile casing is adhered by a suitable adhesive, such as epoxy, to the boot plate. The boot plate is not attached to the mandrel, thus enabling withdrawal of the mandrel such as for adding additional mandrel segments or when the piling target depth is reached.

Pile casing 26 has a cylindrical shell wall with an upper end 38, a lower end 40 and a cylindrical inner surface 42. The pile casing is formed of a composite material comprising fiberglass and a resin matrix. A composite material suitable for this purpose is the Hardcore Fiberglass Tubular Piling® product available from Hardcore duPont Composites, L.L.C. The resin of this material is understood to comprise Dow Derakane® 411-PC100 vinyl ester resin with a reinforcing fiberglass laminate. The fiberglass laminate is understood to be Brunswick Technology Woven E-glass manufacturing by the SCRMP® process, which is a composite resin infusing molding process having 60% fiber volume within average laminates. Composite piles manufactured with this process provide nominal properties of 75 ksi tensile strength, 60 ksi compressive strength, a tensile modulus of 5.45E+6 psi and a compressive modulus of 5.7E+6 psi. This composite material is inert and corrosion resistant, maintains its strength over a long period of time, is resistant to marine borer attack, is low in weight (only approximately 22% of the weight of steel for comparable load-bearing capacity), is environmentally safe in that hazardous chemicals will not leach into the surrounding soil or water, and the pile when in place can be filled with concrete for increasing the design load. Moreover, the piles can be spliced together in situ. Thus, any number of the pile segments can be spliced together as a pile is being driven, depending upon the desired depth.

In a typical application with each pile segment of 40' length, the wall of the pile's cylindrical shell can be of 0.125" thickness with an outer diameter of 14" for fitting about a 13" nominal diameter mandrel. In the embodiment of FIG. 1, a pile trapping device 44 is carried on the shaft of the mandrel for constraining the pile casing for conjoint movement with the mandrel into the hole. This device comprises a structure which includes the provision of adhering annulus 36 of the boot plate to the lower end of the pile casing together with an axially adjustable annular collar 46 mounted just below the mandrel head end. External screw threads 48 are formed along a portion of the upper end of mandrel top section 20, and the axial extent of the threaded portion can be in the range of 8' to 12'. Collar 46 is formed with matching internal threads so that rotation of the collar about the mandrel moves the collar axially up and down along the mandrel shaft. The collar can be manually rotated or, as desired, it could be rotated by a suitable motor or motors, not shown, powered by an electrical, hydraulic or pneumatic source.

A cushioning ring 50 is mounted about the lower end of the collar. The cushioning ring is formed of a suitable material such as hard micarta or hard rubber which will transfer the driving forces from the collar to the pile casing without allowing excessive tensile forces to develop in the pile, which would otherwise occur due to friction between the outer surface of the pile casing and the soil. The ring transfers a part of the downward thrust forces from a hammer's blow into the pile casing. Remaining portions of the thrust forces are simultaneously transferred downward through boot plate 34 which forms a hole that penetrates into the soil. The thus trapped pile casing moves downward with the mandrel through the hole in the soil. The pile driving procedure can continue to the desired depth by repeatedly assembling together the desired number of mandrel segments while also splicing together the desired number of pile segments. When the target depth is reached, the mandrel is withdrawn and, as desired, the space within the pile can be filled with concrete.

Figure 2:
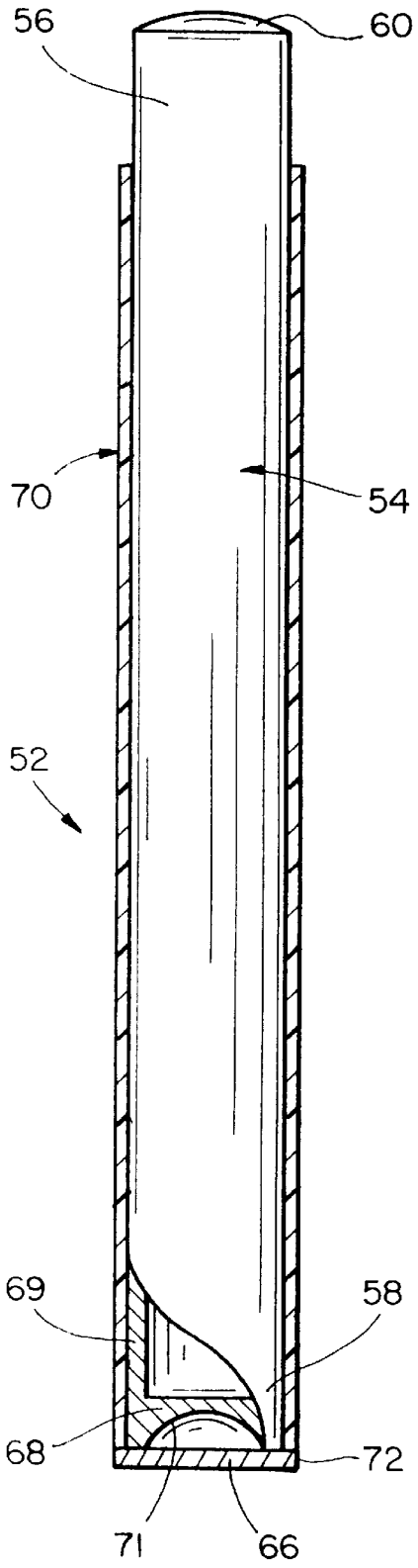
FIG. 2 is an axial section view of a pile driving system of apparatus in accordance with another embodiment of the invention.

FIG. 2 illustrates generally at 52 a pile driving system in accordance with another embodiment of the invention. System 52 is comprised of a mandrel 54 formed of a cylindrical steel shell casing having a head end 56 and foot end 58. A flat or domed cap 60 is welded to the head end for receiving the driving forces from a hammer, not shown.

A boot plate comprised of a circular plate 66, formed of steel or fiberglass material, is positioned below the foot end of the mandrel. A steel bottom or end plug 68 is formed within the mandrel's wall 69 at the foot end, and a downwardly concave recess 71 is shaped in the lower end of the plug. The lower end of plug 68 could be made flat, as desired.

A pile casing 70 of cylindrical shell configuration is sleeved around the mandrel. This casing is formed of a material which is a composite of fiberglass and resin as described for the embodiment of FIG. 1. The outer rim 72 of the boot plate extends below and is adhered by a suitable adhesive to the lower end of the pile casing. The boot plate could also be recessed into the pile casing with adhesive holding the two components together. The boot plate is not attached to the foot end of the mandrel, which can be lifted out of the pile casing leaving the boot plate at the bottom of the hole.

In operation of pile driving system 52, the driving forces from the mandrel are applied only into boot plate 66 with no part of the forces being applied to the pile casing. As the driving forces advance the boot plate down into the soil, the pile casing rides down with the boot plate. As the operation proceeds, additional mandrel sections can be attached by means of welding or a suitable joint construction, as described for the embodiment of FIG. 1. Additional segments of pile casing can be spliced as required.

Figure 3:
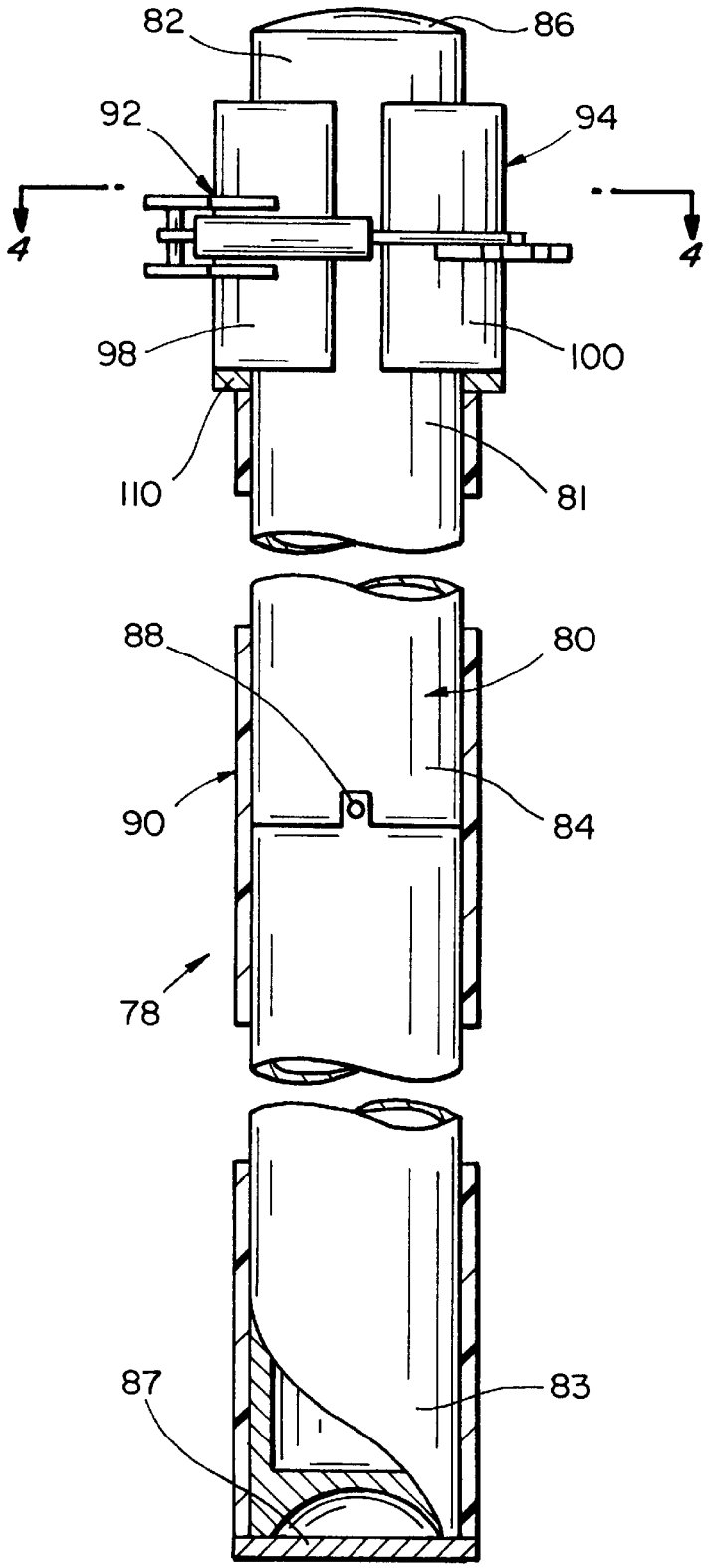
FIG. 3 is an axial section view of a pile driving system of apparatus in accordance with another embodiment of the invention.
Figure 4:
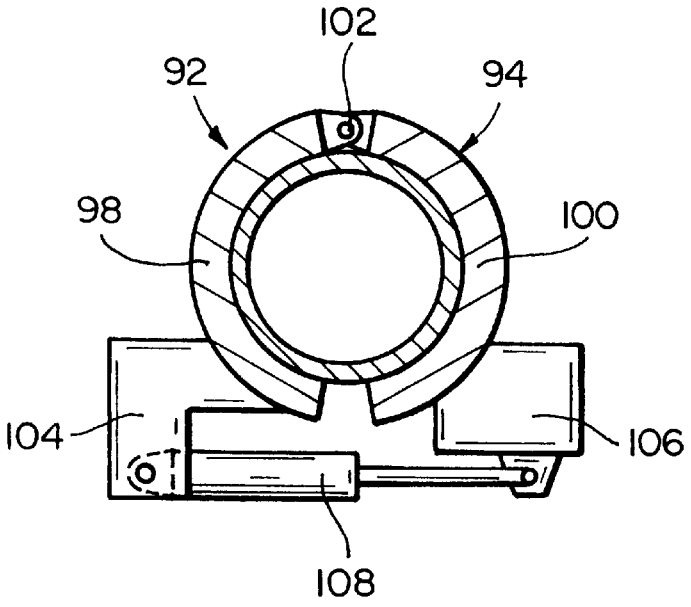
FIG. 4 is a cross section view taken along the line 4—4 of FIG. 3.

FIGS. 3 and 4 illustrate generally at 78 a pile driving system in accordance with another embodiment. This system comprises a cylindrical steel shell mandrel 80 shown in a configuration with an upper segment 81 and lower segment 83. The upper segment has a head end 82, foot end 84 and flat or domed cap 86 welded to the top of the head end. The mandrel segments can be mounted in an end-to-end relationship by means of the tenon and socket joint system 88, which is illustrated, or by welding. A cylindrical shell pile casing 90 is sleeved over the mandrel. The pile casing is formed of a fiberglass and resin composite material of the type explained for the embodiment of FIG. 1.

A boot plate 87 is positioned at the foot end of mandrel segment 83, which is lowermost in the hole. The boot plate can be comprised of a steel or fiberglass circular plate mounted flush below the mandrel and, as shown, equal in diameter to the outer diameter of pile casing 90. As desired, the boot plate could be recessed within the end of the pile casing. In either of the flushed or recessed configurations, the pile casing would be adhered to the boot plate by a suitable adhesive.

A pile trapping device 92 is provided and is comprised of both a grip collar 94 and the provision of adhering the boot plate to the lower end of the pile casing which is lowermost in the hole. Grip collar 94 comprises a pair of C-shaped clamps 98, 100 which are hinged together on one side by means of a pin 102. On the opposite sides of the clamps, support brackets 104 and 106 are mounted for carrying an extensible hydraulic or pneumatic actuator 108. Suitable controls, not shown, are provided for retracting the actuator to draw the clamps together into a tight gripping relationship with the outer surface of the mandrel. When the actuators are extended, the clamps pivot out and are released from the mandrel.

A replaceable cushion element 110 comprising an annulus formed of a suitable material such as hard micarta or hard rubber is mounted between the lower ends of clamps 98 and 100 and the upper end of the pile casing.

Before initiating the driving operation, the pile casing is sleeved over the mandrel with the casing's lower ends adhered to boot plate 87. Grip collar 94, with cushioning element 110 mounted below it, is then sleeved over the head end of the mandrel and moved down until the cushioning element is in juxtaposed relationship with the upper end of the pile casing. Actuator 108 is then retracted so that the clamps 98 and 100 firmly grip the mandrel. A hammer, not shown, is then operated to deliver repeated driving forces into the mandrel. A portion of the driving forces is carried through grip collar 94 and delivered through the cushioning element into the pile casing, which is trapped between the grip collar and boot plate. Another portion of the driving forces is simultaneously transferred by the mandrel into the boot plate, causing it to penetrate through the soil.

Figure 5:
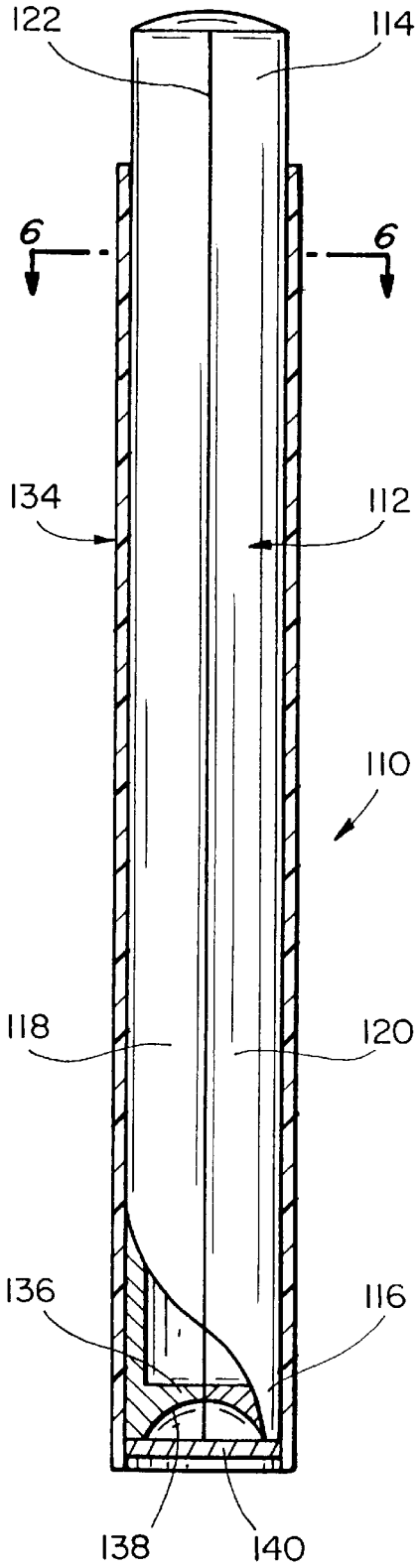
FIG. 5 is an axial section view of a pile driving system of apparatus in accordance with another embodiment of the invention.
Figure 6:
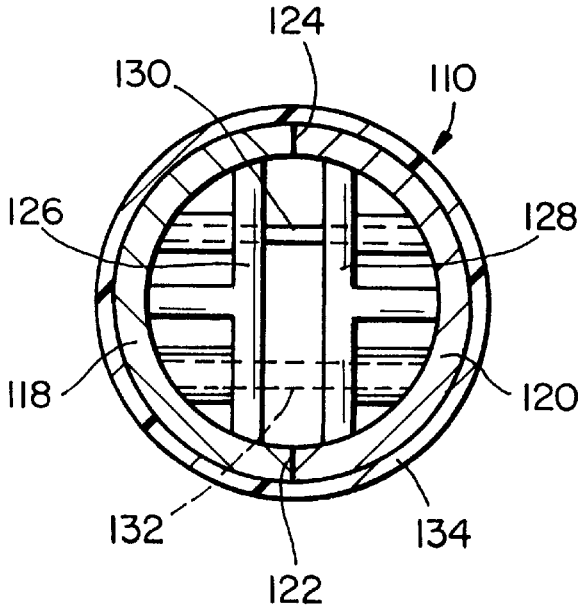
FIG. 6 is a cross section view taken along the line 6—6 of FIG. 5.

FIGS. 5 and 6 illustrate generally at 110 a pile driving system providing apparatus and method of operation in accordance with another embodiment. The system 110 is comprised of an expandable mandrel 112 having a head end 114 and a foot end 116. The expandable mandrel can be of the type disclosed in U.S. Pat. No. 3,984,992 and is comprised of two arcuate segments 118, 120 having opposite sides which, when contracted together, are in juxtaposed relationship along the longitudinal interfaces 122 and 124.

As best shown in FIG. 6, the mandrel segments are provided with respective internal frames 126, 128. The frames slidably mount guide pins 130 which constrain the expanding and contracting movement of the segments in a transverse direction as shown in FIG. 6. A plurality of internally mounted tension springs 132 are provided for contracting the segments together. The segments are expanded outwardly from the positions shown in FIG. 6 by suitable means such as an hydraulic actuator, not shown, mounted internally within the mandrel.

A pile casing 134 is sleeved around the mandrel. The pile casing is of cylindrical shell configuration and is formed of a material which is a composite of fiberglass and resin of the type described in connection with the embodiment of FIG. 1. As the pile is driven deeper, additional sections of both the pile casing and mandrel are joined end-to-end. The foot end of the lowermost mandrel section in the hole is formed into a steel bottom or plug 136. The lower end of the plug is shaped with a concaval recess 138 for distributing the driving forces to the mandrel's outer periphery. As desired, the plug's lower end could be made flat.

A boot plate 140 is positioned at the lower end of the mandrel. The boot plate can be recessed within the lower end of the pile casing, as shown, or it could be of larger diameter and mounted flush on the end of the casing. In either boot plate configuration, the pile casing would be adhered to the boot plate by suitable means such as an adhesive. The boot plate is not attached to the mandrel, which can be lifted out of the pile casing when desired.

Before commencing the pile driving operation, the mandrel segments 118 and 120 are operated to their contracted positions shown in FIG. 6. The first segment of pile casing 134 is sleeved over the mandrel to the position shown in FIG. 5 and its lower end is adhered to the boot plate. The mandrel segments are then actuated to expand outwardly into a tight gripping relationship with the inner surface of the pile casing. A hammer, not shown, is then operated to deliver repeated driving forces into the mandrel. Because of the tight gripping forces exerted over substantially the entire inner surface of the pile casing by the mandrel segments, a portion of the driving forces is directed from the mandrel into the pile casing. Remaining portions of the driving forces are simultaneously delivered by the mandrel against the boot plate, which advances down through the soil.

From the foregoing it is apparent that applicant has provided a pile driving system and method of operation which results in a number of benefits and advantages over conventional systems and methods. The invention enables the driving of composite material pile casings to greater depths in the soil thereby increasing the design load. As a result, the composite material pile casing can perform essentially the same job as steel casings while weighing much less. The result is that the composite pile casings are cost competitive to steel casings. Moreover, the composite casings when in the ground maintain their strength indefinitely in that the material is inert and corrosion resistant, is resistant to marine borer attack and is environmentally safe. After a complete pile is driven into the soil and the mandrel withdrawn, concrete can be filled into the pile casing, as desired.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A pile driving method comprising the steps of providing mandrel together with a pile casing of reinforced synthetic polymer material in which a closed end is provided at the lower end of the pile casing which is not attached to the mandrel, driving the mandrel down into the ground by thrust forces from a hammer device, causing the mandrel to transmit a portion of the thrust forces downward on the closed end, causing the mandrel to pull the pile casing down into the ground while the exterior of the pile casing is in contact with the ground, holding the upper and lower ends of the pile casing against axial movement relative to the mandrel during the step of pulling the pile casing into the ground, the step of holding the pile casing ends is carried out by providing said mandrel with a pair of elongate segments, positioning the segments in side-by-side relationship within the pile casing, moving the segments radially apart into juxtaposed relationship with the pile casing, causing the segments to apply outward forces against the pile casing sufficient to constrain the pile casing against axial movement relative to the mandrel casing while the mandrel is driven down into a soil, and withdrawing the mandrel from the pile casing and ground.

* * * * *